United States Patent [19]

Pearce

[11] 4,081,158

[45] Mar. 28, 1978

[54] MONOCOQUE ARCHED KITE

[75] Inventor: Peter J. Pearce, Studio City, Calif.

[73] Assignee: Synestructics, Inc., Chatsworth, Calif.

[21] Appl. No.: 703,522

[22] Filed: Jul. 8, 1976

[51] Int. Cl.[2] ..... B64C 31/06

[52] U.S. Cl. ..... 244/153 R; 46/77; 46/79

[58] Field of Search ..... 244/153 R, 154, 155 R, 244/155 A; D34/15 AF; 46/77, 79

[56] References Cited

U.S. PATENT DOCUMENTS

| | | | |
|---|---|---|---|
| 1,490,356 | 4/1924 | Wilder | 244/153 R |
| 1,724,539 | 8/1929 | Wilder | 244/153 R |
| 2,465,917 | 3/1949 | Neary | 244/153 R |
| 2,530,641 | 11/1950 | Winslow | 244/153 R |
| 2,588,293 | 3/1962 | Roe | 244/153 R |
| 3,110,460 | 11/1963 | Koonce et al. | 244/153 R |
| 3,237,895 | 3/1966 | Davies | 244/153 R |
| 3,292,883 | 12/1966 | Curtis et al. | 244/153 R |
| 3,350,041 | 10/1967 | English | 244/153 R |
| 3,547,384 | 12/1970 | Clark | 244/154 |
| 3,860,204 | 1/1975 | Checkley | 244/153 R |

OTHER PUBLICATIONS

∓Cobra Kite", *Playthings*, Oct. 1975, p. 68.

*Primary Examiner*—Galen L. Barefoot
*Attorney, Agent, or Firm*—Kleinberg, Morganstern, Scholnick & Mann

[57] ABSTRACT

The aerodynamic surface of the kite consists of a single sheet of stiff material arched about a longitudinal axis, being more highly arched at the front end than at the rear and having an aperture located predominantly on the rearward half. In a preferred embodiment, the kite is die cut from a sheet of foamed plastic, and laterally-extending tension members are used to hold the sheet in the arched shape. The flying string is attached directly to the kite for flying it with the concave side upward. Other embodiments can be flown with the concave side down if a bridle is used.

13 Claims, 13 Drawing Figures

MONOCOQUE ARCHED KITE

BACKGROUND OF THE INVENTION

Field of the Invention

The present invention is in the field of kites and in particular relates to an arched kite of monocoque construction, which is economical to produce, easy to assemble and which flies well.

The Prior Art

In U.S. Pat. No. 1,490,356, issued Apr. 15, 1924, Wilder shows a cylindrical-shaped kite having a bowed lower portion and a flat upper or lifting surface. The flat lifting surface serves as a tension member keeping the normally straight flexible material of the lower portion bowed into the desired cylindrical form. The Wilder kite does not have an aperture in its aerodynamic surface, nor does its surface have the unique non-cylindrical form used in the present invention.

U.S. Pat. No. 2,588,293 issued Mar. 4, 1952 to Roe discloses a kite formed of a single piece of material. Although a portion of the Roe kite has a conical shape, the axis of the cone is directed downward rather than longitudinally. As a result, the Roe kite is somewhat lacking in yaw stability and therefore requires a 3-point bridle and a tail for satisfactory performance.

In his application Ser. No. 596,015 filed July 15, 1975 for CONCAVE PARABOLIC ARCHED KITE, and now U.S. Pat. No. 4,018,408, Applicant discloses an arched kite of cylindrical form for flying with the concave side downward. That invention required both front and rear sails as well as a framework formed of a number of struts and connectors.

None of these prior art kites is regarded as providing the unique combination of advantages afforded by the present invention. These features include economy of production, ease of assembly and outstanding flying qualities.

SUMMARY OF THE DISCLOSURE

The kite of the present invention is extremely economical to produce because, in a preferred embodiment, the entire kite including the aerodynamic surfaces, tension members and reinforcing members are all die cut in a single operation from a single sheet of polystyrene foam. That material has a favorable stiffness-to-weight ration, and is stiff enough to be bowed or bent to an appropriate shape.

Assembly of the kite is extremely simple. First, the die-cut parts are pushed free of the residue of the piece of foam. Next, the one-piece aerodynamic surface is bowed to an appropriate arched shape and two tension members are inserted at selected spots into preformed holes in the aerodynamic surface to constrain the aerodynamic surface to remain in its bowed configuration. The flying string is then inserted through a predetermined hole in the aerodynamic surface and is secured in position by a reinforcing member.

Because both of the tension members are the same length, it is impossible to assemble the kit incorrectly. No bridle system is used with the kite, the flying string being connected directly to the aerodynamic surface. Further, it is not necessary to provide a tail for the kite, although an ornamental one may be used if desired.

The resulting kite has an unusually high area-to-weight ration and hence is especially well adapted for flying when the wind speed is low. Notwithstanding the fact that the kite is flown with a single flying string and no bridle in a preferred embodiment, the kite exhibits excellent stability and flies high overhead with a relatively low angle of attack. In a preferred embodiment, the entire kite is formed of the same material. The largest part is the aerodynamic surface which is a unitary sheet of predetermined shape having an aperture of moderate size predominantly on its rearward half. This aperture may be thought of as dividing the aerodynamic surface into a forward aerodynamic surface and an aft (rearward) aerodynamic surface connected by portions of the aerodynamic surface which extend around the aperture at the sides.

The key to the unique flying ability of the kite is its unusual shape. The arched aerodynamic surface is flown with its concave side up, but the aerodynamic surface is more tightly arched at its front end than at its rear end. That is, the radius of curvature of the aerodynamic surface in a plane perpendicular to the longitudinal axis is smaller at the front of the kite than it is at the rear of the kite. As a result, the aerodynamic surface could be visualized as substantially conforming to a portion of the surface of an imaginary cone having its axis of symmetry disposed in the longitudinal direction.

In a preferred embodiment, a longitudinally extending score is made on the rear aerodynamic surface from the aperture to the rearmost edge of the kite. When this has been done, the aft aerodynamic surface tends to acquire a V-shape when the laterally extending tension members have been placed into position.

In other embodiments, only a forward tension member is used, the rearward tension member being omitted, while in other embodiments, the rear aerodynamic surface is not scored and therefore assumes a curved form rather than a V-shaped form.

If the kite were initially molded of sufficiently stiff material to the desired shape, then no tension members at all would be required and the kite would consist of the unitary aerodynamic surface only.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 2, including

FIG. 4 including

DESCRIPTION OF THE PREFERRED EMBODIMENTS

Figure 1:
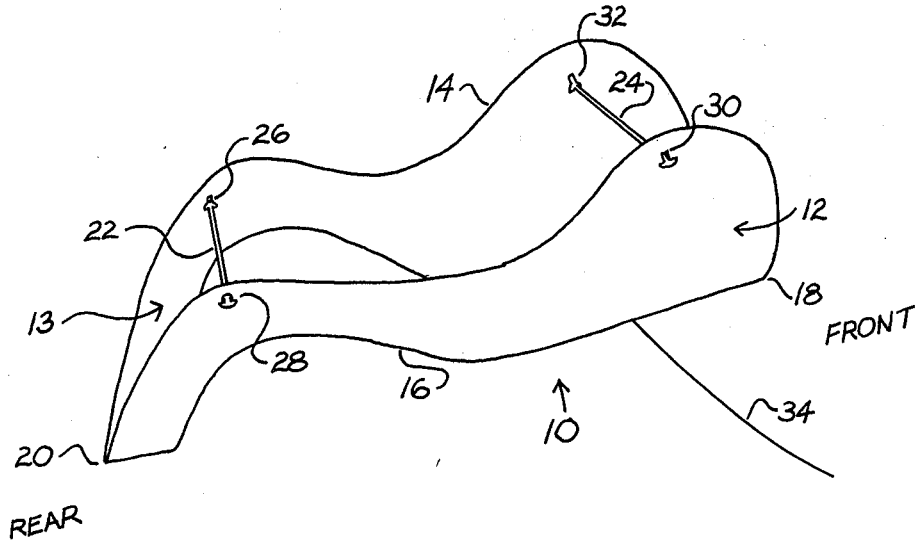
FIG. 1 is a perspective view of the kite in flight as seen from the side from a slightly elevated position.

Referring now to the drawings, in which like reference numerals indicate like parts, there is shown in FIG. 1 a perspective view of the kite 10 in flight. The view of FIG. 1 is from the side and slightly above the kite. FIG. 2 also is a perspective view of a preferred embodiment of the kite as seen from above and behind the kite.

The kit includes a forward aerodynamic surface 12 and an aft aerodynamic surface 13. These aerodynamic surfaces are formed, as will be shown below, from a single piece of foam plastic in a preferred embodiment. The periphery 14 of the sheet has a generally curved shape also shown in FIG. 5. The one-piece sheet of which the aerodynamic surfaces are formed includes an edge portion 16 defining an aperture lying predominantly on the rearward half of the sheet.

In the preferred embodiment, the shape of the kite is maintained by the tension members 22, 24 which extend laterally to connect opposite sides of the kite. In the preferred embodiment, the tension members 22, 24 have the appearance shown in FIG. 5, including enlarged end sections 40, 42, 44 and 46. These end sections are inserted through the holes 26, 28, 30 and 32, where they serve to restrain the tendency of the opposite sides to spread apart.

Figure 2A:
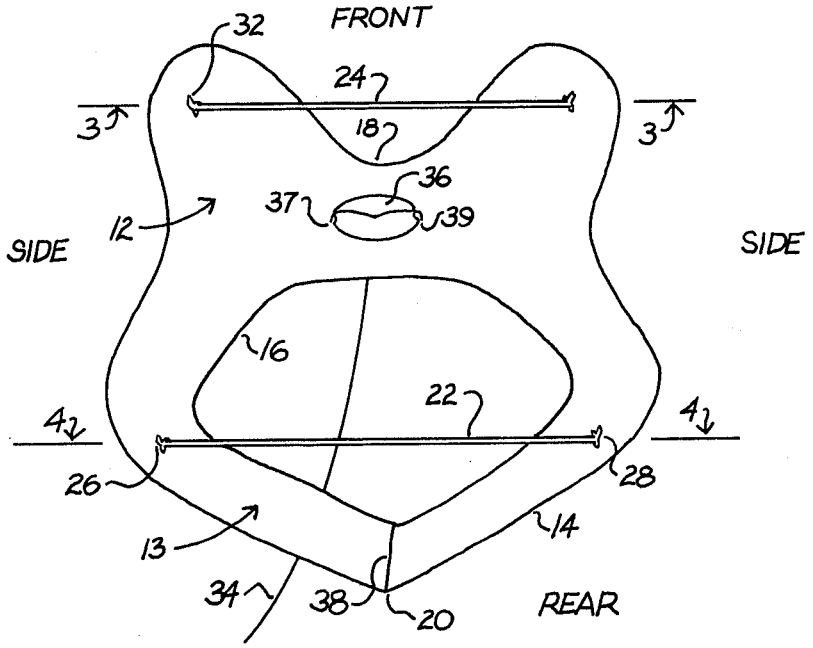
FIGS. 2*a*, 2*b*, 2*c* and 2*d*, are perspective views of various embodiments of the kite as seen from a position above and behind the kite while it is in flight.
Figure 5:
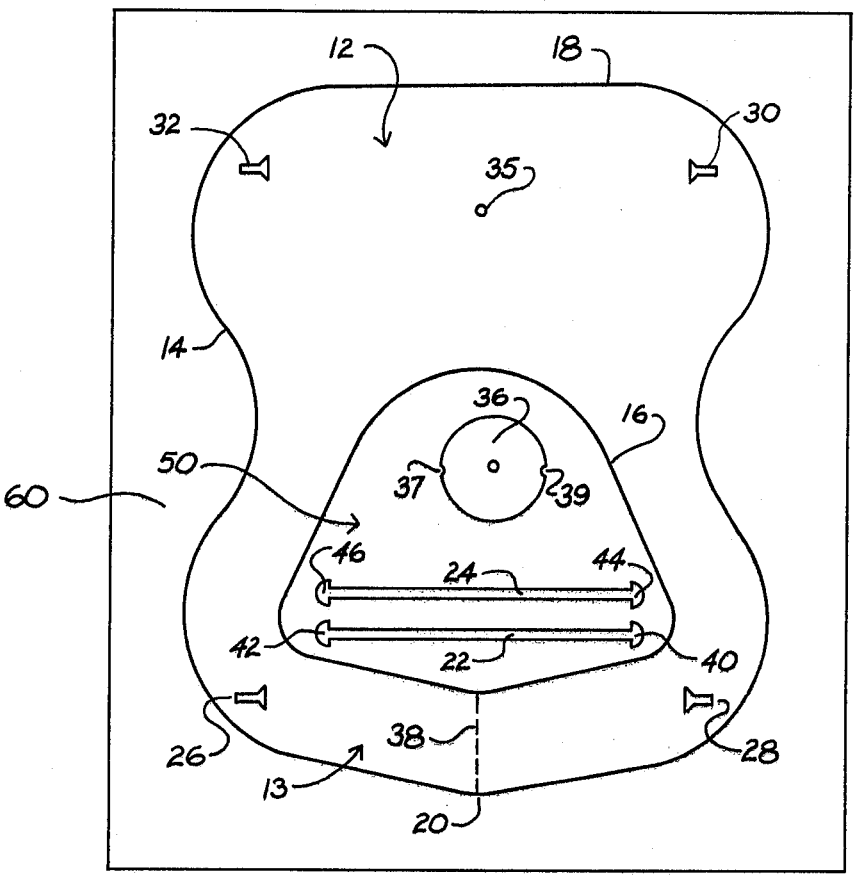
FIG. 5 is a plan view of the kite as it is die cut and scored onto a sheet of material.

In the preferred embodiments of FIGS. 1, 2*a* and 5, the kite is flown from a single flying string 34. That string is inserted through a hole 35 in the forward aerodynamic surface 12 and a loop is tied in the string 34 at its end. The loop is then passed around the reinforcing disc 36, which has two small grooves 37 and 39 to retain the string. The reinforcing disc 36 helps to distribute the stresses exerted by the flying string 34 over a relatively wide area of the forward aerodynamic surface 12, thereby preventing undue wear on the edges of the hole 35.

In the preferred embodiment, a laterally centered score 38 is made across the aft aerodynamic surface 13 of the kite 10 extending in the longitudinal direction. The score extends from the inner perimeter 16 defining the aperture to the rearmost edge 20 of the kite. When scored in this manner, the aft aerodynamic surface 13 of the kite assumes a V-shaped configuration as shown in FIGS. 1, 2*a*, 4*a*, and 5.

Figure 2B:
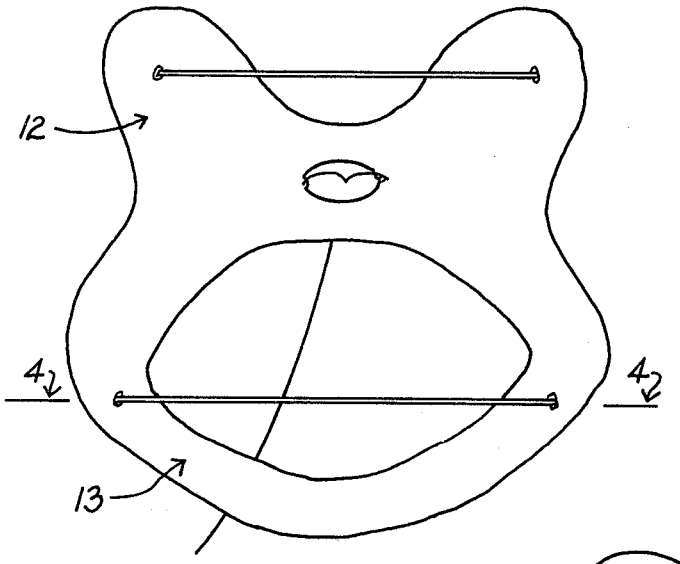
Figure 2C:
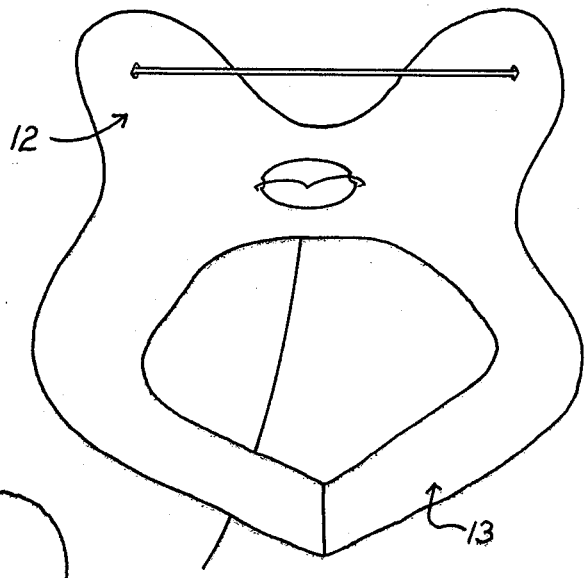

Substantially the same shape results if the rear tension member 22 is omitted as shown in FIG. 2*c*. That embodiment, however, is not as rigid as the preferred embodiment and therefore the use of a stiffer and generally heavier material for the aerodynamic surface amy be indicated.

The embodiment shown in FIG. 2*b* is similar to the preferred embodiment except that the rear aerodynamic surface 13 is not scored. As a result, the rear aerodynamic surface of the embodiment shown in FIG. 2*b* has the shape shown in cross section in FIG. 4*b*.

Figure 2D:
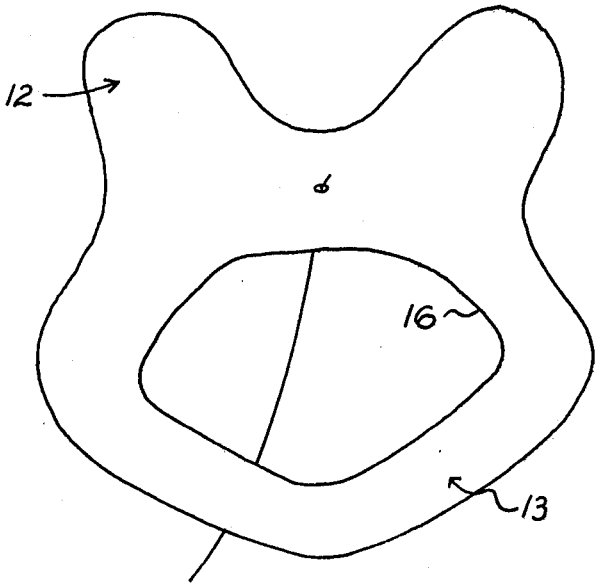

FIG. 2*d* shows a further embodiment formed of very stiff material which has been preformed to the appropriate arched shape. In that embodiment, no tension members are used at all and the kite is reduced to its simplest terms, namely the unitary sheet of stiff material which has a shape defining the aerodynamic surfaces 12 and 13. The edge 16 defines an aperture occupying an appreciable portion of the aerodynamic surface predominantly on its rearward half.

In any embodiment using tension members, those members could be replaced by struts, i.e., members capable of supporting compression as well as withstanding tension, without affecting the flying qualities of the kite.

Figure 3:
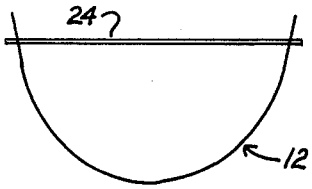
FIG. 3 is a cross sectional view through the kite of FIG. 2*a* taken at the section 3—3.
Figure 4A:
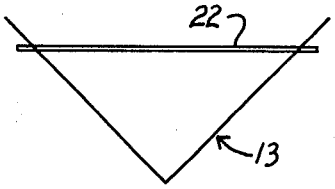
FIGS. 4*a* and 4*b*, are cross sectional views of the rear aerodynamic surface of the kite in the preferred embodiment and an alternative embodiment respectively in the direction 4—4 of FIG. 2*a* and FIG. 2*b*, respectively.
Figure 4B:
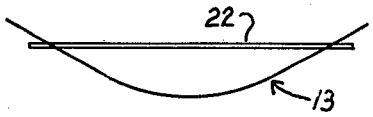

It has been found that the flying qualities of the kite are strongly dependent on the arched shape of the kite. FIG. 3 is a cross sectional view showing the arched shape of the kite in the vicinity of the forward tension member 24. FIGS. 4*a* and 4*b* show the shape of the rearward aerodynamic surface 13 in the region of the rearward tension member 22.

In all embodiments of the kite, the surface is more highly bowed near the forward tension member than at the rearward tension member. This can be seen by comparing FIG. 3 with FIG. 4*b*, noting that the aerodynamic surface has been bowed into a deeper, more highly curved configuration in the vicinity of the forward tension member. It has been found that if this gradiation of curvature from the front to the rear of the kite is not maintained, the kite will exhibit poor aerodynamic stability.

The arched shape of the kite may also be understood by visualizing it as substantially conforming to portions of the surface of an imaginary cone having its axis of symmetry extending in the longitudinal direction and its apex in front of the kite. FIG. 5 shows how the kite is produced in a preferred embodiment. In that embodiment, the kite is die cut from a single sheet 60 of polystyrene foam. The sheet is approximately 2 mm. in thickness and has a stiffness comparable to that of several layers of bristol board. The sheet 60 is substantially flat initially.

The kite is die cut into the foam sheet 60 in a single operation. Further, if it is desired to score the rear aerodynamic surface 13, the score 38 can be applied to the foam in the same operation as the die cutting. The dies cut curves into the foam defining the outer periphery 14 of the kite, the inner periphery 16, the holes 26, 28, 30 and 32, the tension members 22 and 24, and the reinforcing disc 36. Economy is achieved by die cutting the tension members 22, 24 and the reinforcing disc 36 into the material 50 which otherwise would be disposed of when providing the aperture of the kite.

In the preferred embodiment, the tension members 22, 24 are equal in length, thereby eliminating the possibility that if they were of different lengths they might be inadvertently interchanged.

The kite is assembled by pushing out the precut portions of the sheet 60, and manually bowing the sheet 60 about the kite's longitudinal axis so that the tension members 22, 24 can be inserted into the holes 26, 28 and 30, 32, respectively. Next, the flying string 34 is inserted through the hole 35 and secured to the reinforcing disc 36 as described above. Much of the simplicity of construction of the kite results from its monocoque structure which obviates the need for a structural framework. Thus, for example, the need for structural connectors has been eliminated altogether.

The technique shown in FIG. 5 for producing the kite is applicable to all of the above-described embodiments. However, the embodiment of FIG. 2*d*, which lacks tension members, would require a further step of setting the arched shape into the sheet. Although the preferred embodiment contemplates forming the kite of a polystyrene foam, it is clear that other materials having various degrees of stiffness could also be employed. The polystyrene foam is preferred because it results in a kite having a high area-to-weight ratio. This, in turn, permits the kite to be flown even when the wind speed is low.

Figure 6:
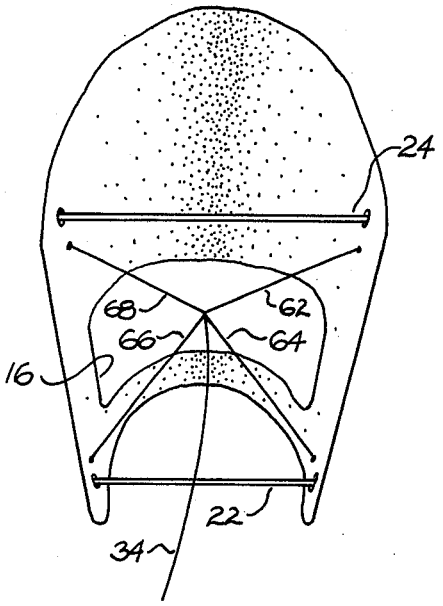
FIG. 6 is a perspective view of an alternative embodiment of the kite in flight with the concave side down using a 4-string bridle.
Figure 7:
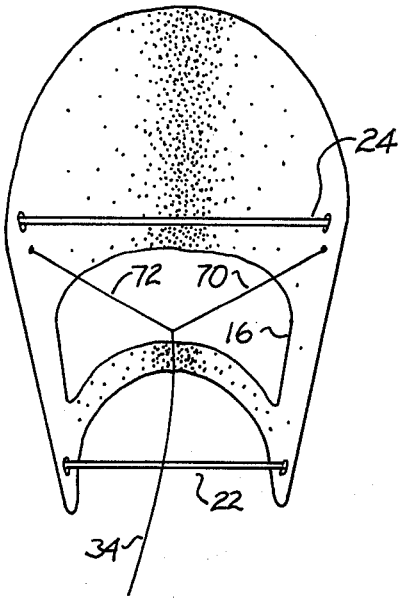
FIG. 7 is a perspective view from below the kite showing an alternative embodiment in flight with the concave side down using a 2-string bridle.

Applicant has discovered that the embodiment of his kite shown in FIGS. 6 and 7 can be flown with the concave side down, as shown in those figures. Further, it has been found that the 4-point bridle 62, 64, 66, 68 of FIG. 6 is slightly preferable to the 2-point bridle 70, 72 of FIG. 7.

Figure 8:
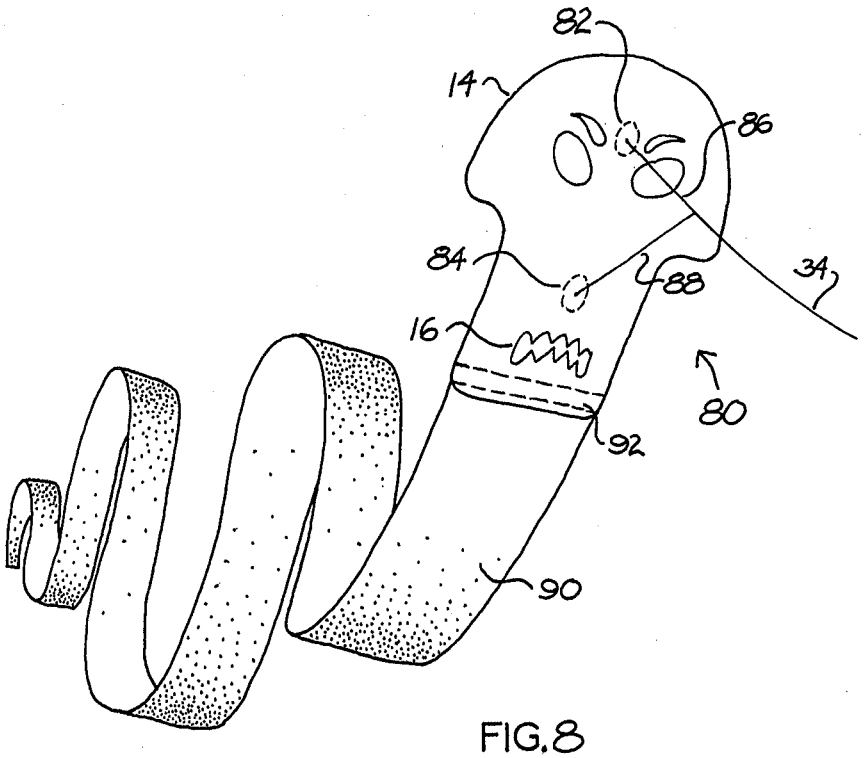
FIG. 8 is a perspective view from below the kite showing another alternative embodiment.

A further embodiment 80 of the present invention is shown in FIG. 8. It is a "dragon kite," die cut from a single sheet of foamed plastic in the same manner as the embodiment shown in FIG. 5. The embodiment of FIG. 8 uses no tension members and in that respect resembles the embodiment of FIG. 2*d*.

The kite of FIG. 8 is given a longitudinally-extending arch by die cutting it from a pre-shaped sheet of foamed plastic. Alternatively, the arch may be set into the material after it has been die cut. The arched shape may be either conical or cylindrical.

The die-cut "eyes" are punched out and used as the reinforcing discs 82, 84 to secure the bridle strings 86, 88 to the kite and to distribute the stresses applied by the strings. The "eye" holes prevent excessive pressure on the forward aerodynamic surface from bowing the kite excessively and possibly breaking it.

A 2-point bridle has been found to be best for flying this embodiment. The forward bridle string 86 should be substantially perpendicular to the longitudinal centerline of the kite.

A tail 90 consisting of a sheet of plastic film is attached by a strip of an adhesive tape 92 to the upper concave surface of the kite on its aft aerodynamic surface.

Figure 9:
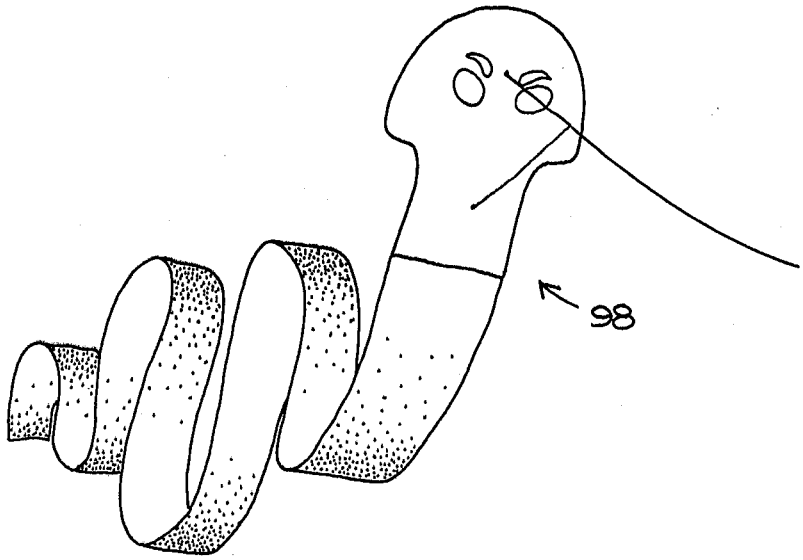
FIG. 9 is a perspective view from below the kite showing another embodiment.

Another embodiment 98 of the "dragon" kite is shown in FIG. 9. That embodiment differs from the embodiment of FIG. 8 only in that the "mouth" aperture has been eliminated. The "eye" apertures are accordingly made larger than in the embodiment of FIG. 8 and they substantially replace the "mouth" aperture in function as well as structurally.

Thus, there has been described a novel kite having a structure which permits it to be mass produced economically, to be readily assembled without possibility of error, and which exhibits excellent aerodynamic stability and ability to fly under low wind speed conditions.

Other embodiments of the present invention and modifications of the embodiments presented herein may be developed without departing from the essential characteristics thereof. Accordingly, the invention should be limited only by the scope of the claims appended below.

What is claimed is:

1. A kite comprising a unitary sheet of a relatively stiff flexible material arched about a longitudinal axis and having a forward aerodynamic surface, an aft aerodynamic surface and an aperture through said sheet longitudinally intermediate said forward aerodynamic surface and said aft aerodynamic surface, a forward tension member and an aft tension member of substantially equal length, each said tension member connected between corresponding opposing points proximate the sides of the kite, wherein the separation measured along the arched surface of the kite between the connected opposing points of said forward tension member is greater than the separation measured along the arched surface of the kite between the connected opposing points of said aft tension member, holding the surface of the kite in a shape approximating that of a portion of the surface of a cone having a longitudinally-directed axis.

2. The kite of claim 1 further comprising a reinforcement member having a surface substantially in contact with the area of the kite surface where said string is attached, for reinforcing the kite surface in that area.

3. The kite of claim 2 wherein said kite is die cut from a sheet of stiff foamed plastic with said reinforcement member being simultaneously die cut from a portion of the sheet lying within said aperture.

4. The kite of claim 1 further comprising a flying string attached to said kite at a laterally centered point between the aperture and the frontmost edge of the kite, for flying the kite with its concave surface up.

5. The kite of claim 1 further comprising a bridle for connecting a flying string to the kite, for flying the kite with its concave surface down.

6. The kite of claim 5 wherein said bridle includes strings connecting said flying string with opposite sides of the kite.

7. The kite of claim 1 wherein said unitary sheet is scored along a laterally-centered line extending longitudinally from the aperture to the rearmost edge of the sheet, whereby the section of the kite rearward of the aperture assumes a V-shaped configuration as viewed from the rear of the kite.

8. The kite of claim 7 wherein said kite is die cut from a sheet of stiff foamed plastic and scored in the same operation.

9. The kite of claim 1 wherein said aperture is laterally centered.

10. The kite of claim 1 further comprising a second aperture laterally adjacent said aperture to present the appearance of a pair of eyes.

11. The kite of claim 10 wherein said apertures are disposed symmetrically about a longitudinal axis.

12. The kite of claim 1 further comprising a tail of plastic film attached to said aft aerodynamic surface.

13. The kite of claim 2 wherein said tail is shaped to present the appearance of a dragon's tail.

* * * * *